US011408242B2

(12) United States Patent
Stokes et al.

(10) Patent No.: US 11,408,242 B2
(45) Date of Patent: Aug. 9, 2022

(54) CONSUMABLE PACKER ELEMENT PROTECTION FOR IMPROVED RUN-IN TIMES

(71) Applicant: Halliburton Energy Services, Inc., Houston, TX (US)

(72) Inventors: Matthew Bradley Stokes, Keller, TX (US); Michelle Brianne Henckel, Grapevine, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 19 days.

(21) Appl. No.: 15/569,043

(22) PCT Filed: Jul. 22, 2016

(86) PCT No.: PCT/US2016/043618

§ 371 (c)(1),
(2) Date: Oct. 24, 2017

(87) PCT Pub. No.: WO2018/017128

PCT Pub. Date: Jan. 25, 2018

(65) Prior Publication Data

US 2019/0128074 A1 May 2, 2019

(51) Int. Cl.
*E21B 33/12* (2006.01)
*E21B 33/134* (2006.01)

(52) U.S. Cl.
CPC ..... *E21B 33/12* (2013.01); *E21B 33/134* (2013.01)

(58) Field of Classification Search
CPC ..... E21B 33/12; E21B 33/134
See application file for complete search history.

(56) References Cited

U.S. PATENT DOCUMENTS 2,991,834 A * 7/1961 Kennard ..... E21B 31/16 166/55.7
3,916,999 A 11/1975 Ellis et al.
4,862,967 A 9/1989 Harris
5,052,489 A * 10/1991 Carisella ..... E21B 43/1185 166/297
7,168,494 B2 1/2007 Starr et al.
7,387,158 B2 6/2008 Murray et al.
7,712,541 B2 * 5/2010 Loretz ..... E21B 47/011 166/376
7,861,791 B2 1/2011 Kilgore et al.
(Continued)

OTHER PUBLICATIONS

International Search Report and The Written Opinion of the International Search Authority, or the Declaration, Apr. 18, 2017, PCT/US2016/043618, 15 pages, ISA/KR.

(Continued)

*Primary Examiner* — Jonathan Malikasim
(74) *Attorney, Agent, or Firm* — Haynes and Boone, LLP

(57) ABSTRACT

A sacrificial shroud is disposed over a packing element of a downhole packer to provide isolation from incompatible wellbore fluids and to minimize a tendency for swabbing or packer preset due to fluid flow past the packing element during run-in, thereby allowing for faster run-in speeds. The shroud may be depletive or consumable, such as by dissolution into a wellbore fluid or by melting at a predetermined downhole thermodynamic condition. The shroud may take the form of a sleeve or an applied coating.

7 Claims, 6 Drawing Sheets

(56) References Cited

U.S. PATENT DOCUMENTS

| | | | | |
|---|---|---|---|---|
| 9,127,527 | B2 * | 9/2015 | Frazier | E21B 33/129 |
| 2004/0194971 | A1 | 10/2004 | Thomson | |
| 2007/0125532 | A1 | 6/2007 | Murray et al. | |
| 2008/0099209 | A1 | 5/2008 | Loretz et al. | |
| 2008/0149351 | A1 | 6/2008 | Marya et al. | |
| 2008/0277109 | A1 | 11/2008 | Vaidya | |
| 2010/0025035 | A1 | 2/2010 | Korte et al. | |
| 2011/0048743 | A1 | 3/2011 | Stafford et al. | |
| 2013/0025849 | A1 | 1/2013 | Richard et al. | |
| 2015/0211323 | A1 | 7/2015 | Atkins et al. | |
| 2015/0275617 | A1 | 10/2015 | Lou et al. | |
| 2016/0201425 | A1 | 7/2016 | Walton et al. | |

OTHER PUBLICATIONS

Extended European Search Report issued by the European Patent Office for European Application No. EP 16 90 9718, dated Aug. 22, 2019, 8 pages.

Written Opinion issued by the Intellectual Property Office of Singapore regarding related Singapore patent application No. 11201810206S, dated May 5, 2020, 12 pages.

* cited by examiner

CONSUMABLE PACKER ELEMENT PROTECTION FOR IMPROVED RUN-IN TIMES

PRIORITY

The present application is a U.S. National Stage patent application of International Patent Application No. PCT/US2016/043618, filed on Jul. 22, 2016, the benefit of which is claimed and the disclosure of which is incorporated herein by reference in its entirety.

TECHNICAL FIELD

The present disclosure relates generally to petrolic downhole equipment and, more specifically, to elastomeric packers used for well completion, cementing, and other downhole operations.

BACKGROUND

Downhole packers are commonly used in many oilfield applications for the purpose of sealing against the flow of fluid to isolate one or more portions of a wellbore for the purposes of testing, treating, or producing the well. Non-limiting examples of fluid include: liquids such as oil and water, gases such as natural gas, and three-phase flow. Packers may be classified as retrievable or permanent.

To deploy a packer, the packer in a radially contracted state may be suspended in an open or cased wellbore from a production tubing string, working string, wireline, or the like. Once in position, the packer may be set, for example by application of tension, compression, or hydraulic force, so that one or more slips or other anchor mechanism engages the inner surface of the wellbore or casing, thus fixing the packer within the wellbore. Setting the packer radially expands an elastomeric sealing or packing element into engagement with the inner surface of the wellbore or casing, thereby preventing fluid flow through the annulus.

Packing elements may be formulated using a limited number of different rubber compounds, as most of the elastomers capable of handling a wide variety of oil field fluids are also characterized by low tensile strength and extrusion resistance, making them unsuitable for use. Therefore, most packer sealing elements are made from a tough nitrile material, such as nitrile butadiene rubber (NBR) or hydrogenated nitrile butadiene rubber (HNBR).

However, when exposed to an incompatible fluid, which may occur during running into the wellbore, the sealing packer element may begin to rapidly degrade. For this reason, in addition minimizing the high hourly cost of well operations, it may be desirable to limit the amount of time the packers exposed to such incompatible fluid by increasing the run-in speed. A high run-in speed may cause the rubber packing element to begin to prematurely pack-off or swab. This phenomenon occurs because the viscous wellbore fluid flowing past the rubber packing element during run-in tends to pull the packing element outwards toward the wellbore wall. Fluid flow past the packer may also damage other elements of the packer, including slips, wedges, and the like.

BRIEF DESCRIPTION OF THE DRAWINGS

Embodiments are described in detail hereinafter with reference to the accompanying Figures, in which.

DETAILED DESCRIPTION

Figure 1:
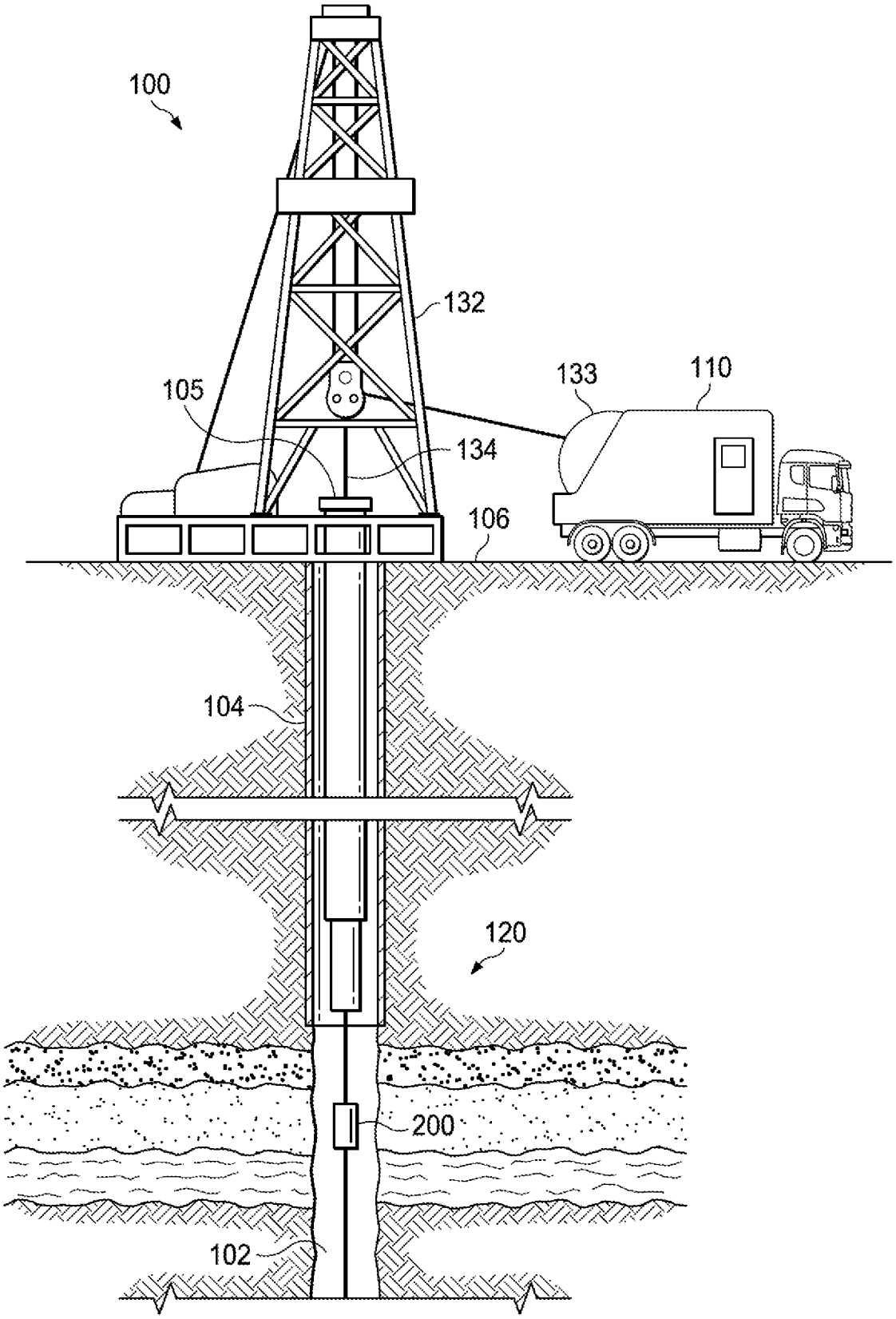
FIG. 1 is an elevation view in partial cross-section of an exemplary well system, showing a downhole packer according to an embodiment of the principles of the present disclosure being run into a wellbore by a wireline or coiled tubing conveyance.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the Figures. The spatially relative terms are intended to encompass different orientations of the apparatus in use or operation in addition to the orientation depicted in the figures.

FIG. 1 shows an exemplary well system 100 that includes a packer 200 according to an embodiment deployed in a wireline environment. In some example wireline operations, a platform above surface 106 that is equipped with a derrick 132 or a winch 133 that supports a conveyance 134 that extends into wellbore 102, which may include casing 104. Wireline operations can be performed, for example, after a drilling string is removed from wellbore 102 to allow packer 200 to be lowered by wireline into the wellbore 102, for example in conjunction with one or more well logging operations. Conveyance 134 may be a coiled tubing, wireline cable, or another structure that carries packer 200.

Figure 2:
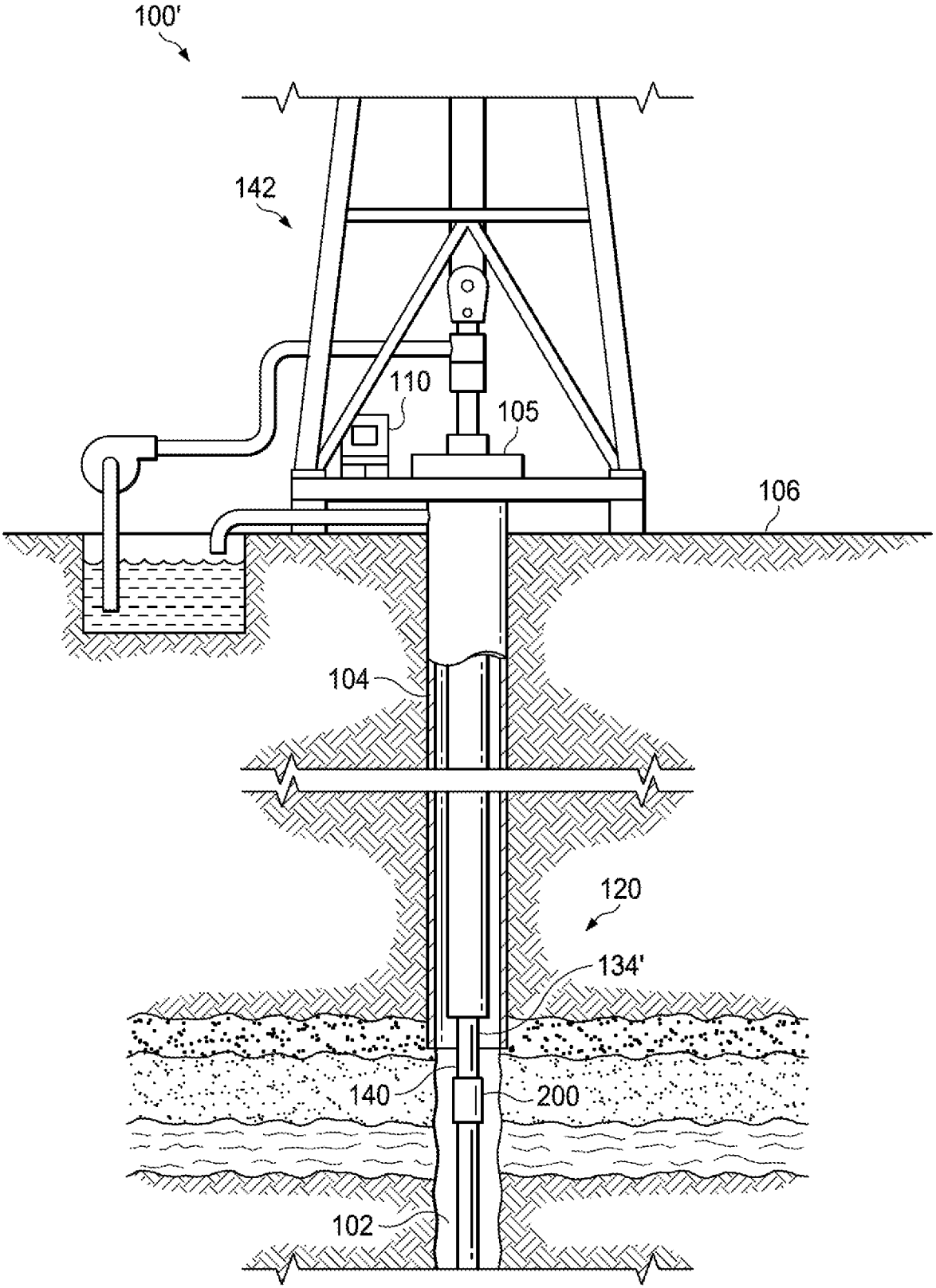
FIG. 2 is an elevation view in partial cross-section of an exemplary well system, showing a downhole packer according to an embodiment of the principles of the present disclosure being run into a wellbore by a drill string, working string, or production tubing string conveyance.

FIG. 2 shows an exemplary well system 100' that includes a packer 200 according to an embodiment deployed in a typical string-running environment, such as used during drilling of wellbore 102. A conveyance 134' may be formed of stands or individual lengths of pipes connected together to form a string 140 that is lowered into wellbore 102. String 140 carries packer 200. A drilling rig 142 at surface 106 may support string 140. String 140 may be a drill string, which in addition to drill pipe may include, for example, a kelly, drill collars a bottom hole assembly with mud motor, a drill bit, and other components (not illustrated). String 140 may also be a production tubing string when completing a well for production or a working string for cementing, perforating, or other operations.

As described herein, illustrative embodiments of the present disclosure are directed to packer 200 having a consumable, sacrificial protective element positioned thereon which protects the packer element and optionally other packer components from adverse effects of the environment and fluid flow in wellbore 102 until such time as packer 200 is ready to be set. The protective element may take a variety of forms, as described hereinafter.

Figure 3:
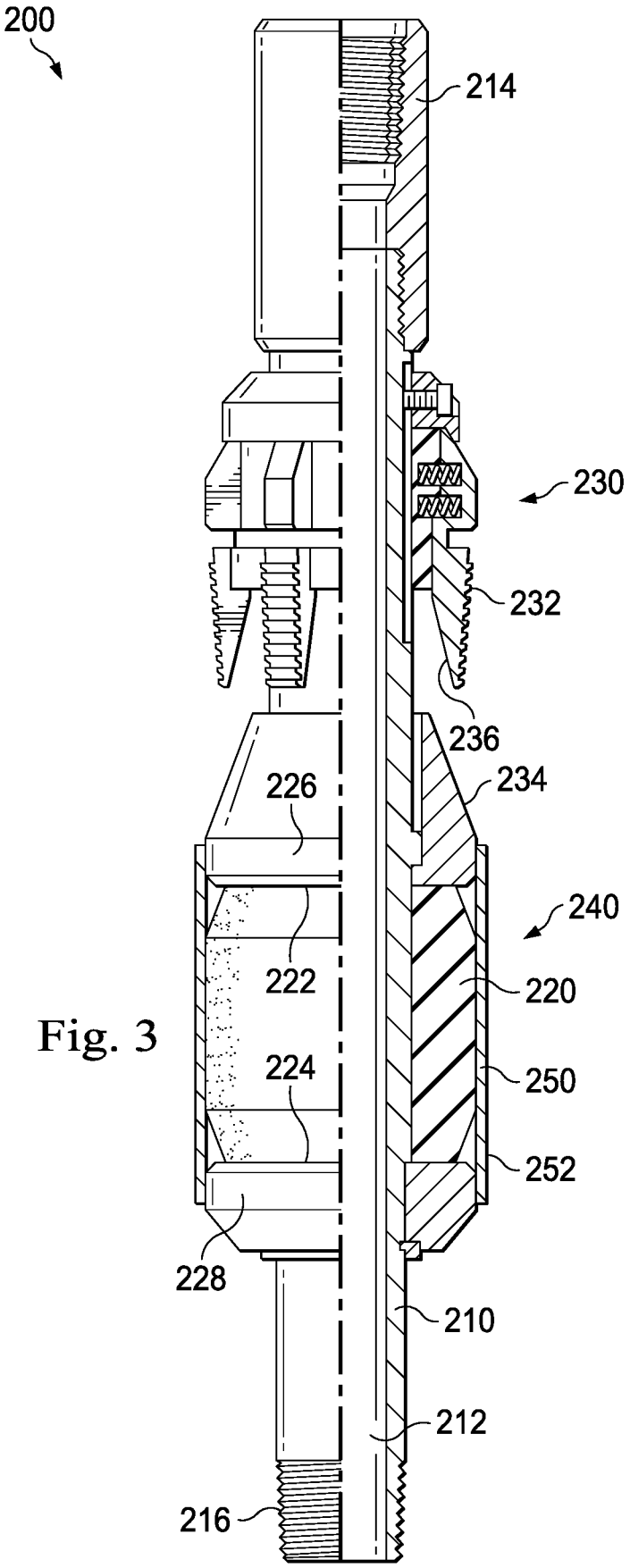
FIG. 3 is an elevation view in partial cross-section of an exemplary downhole packer which may be used in conjunction with the well system of FIG. 2, showing an elastomeric packing element covered by a sleeve-shaped depletive shroud according to an embodiment.

FIG. 3 is an elevation view in partial cross-section of a packer 200 according to one or more embodiments. In the embodiment illustrated, packer 200 is a retrievable tension-set packer. However, present disclosure is not limited to a particular type of packer. Retrievable or permanent seal packers, compression-set packers, wireline-set packers, tension/compression-set packers, hydraulic-set packers, hydrostatic-set packers, swellable packers, dual and multiple string packers, and packers with or without fluid bypass may equally be used in accordance with the principles of the present disclosure.

Packer 200 may include a body or mandrel 210. Mandrel 210 may be tubular nature for providing a flow path 212 through packer 200. Mandrel 210 may be included along string 140 (FIG. 2) via box connector 214 and pin connector 216. However, other types of connectors may be used as appropriate. Mandrel 210 may also be included along other types of conveyance 134, such as wireline or coiled tubing (see FIG. 1).

Packer 200 includes a radially expandable sealing or packing element 220 carried about mandrel 210. In an un-deployed state, packing element 220 has an outer diameter that is smaller than the inner diameter of the open hole wall or casing 104 of wellbore 102 (FIGS. 1, 2) so as to allow packer 200 to be run into wellbore 102. In a deployed state, packing element 220 is radially expanded to have an outer diameter sufficient so that the packing element 220 completely engages the wellbore wall so as to form a fluid tight seal.

Although in one or more embodiments, packing element 200 is not limited to a particular type of material, packing element 220 may be made of a resilient material such as a rubber or elastomer. In one or more embodiments, packing element 220 may be made from a nitrile material such as nitrile butadiene rubber ("NBR") or hydrogenated nitrile butadiene rubber ("HNBR"), which may have suitable mechanical and fluid-resistance properties for downhole use. In a swellable packer, packing element 220 may be made of a water- or oil-swellable elastomer or thermoplastic such water-absorbent resins, cross-linked products of polyacrylates, cross-linked products of starch-acrylate graft copolymers, cross-linked products of a hydrolyzate of starch-acrylonitrile graft copolymer, and cross-linked products of carboxymethylcellulose. Additionally, packing element 220 may be made of an ethylene propylene rubber ("EPM"), because, as discussed hereinafter, a consumable or depletive shroud initially covers packing element 220 and may protect packing element 220 from adverse effects of incompatible fluids during running in hole.

Packer 200 may include an actuation mechanism 240 for radially expanding packing element 220. Packing element 220 may be radially expanded by axial compression between upper and lower shoulders 222, 224 of actuation mechanism 240, as shown in FIG. 3. Packing element 220 may also be radially expanded by inflation of a hollow bladder (not illustrated) within packing element 220, or by physical swelling of the material comprising packing element 220.

Packer 200 may include anchoring mechanism 230 operable from an unexpanded configuration to an expanded configuration to selectively fix packer 200 at a given location within wellbore 102 (FIG. 2). In the retrievable tension-set packer illustrated in FIG. 3, anchoring mechanism 230 includes a set of serrated slips or wickers 232 and a cone 234. As shown in FIG. 3, in the unexpanded configuration, the anchoring mechanism 230 is spaced apart from the actuation mechanism 240. Slips 232 are arranged to engage the wellbore wall upon initial upward movement of packer 200. As upward movement of packer 200 continues, mandrel 210 slides within anchoring mechanism 230 thereby bringing cone 234 into engagement with the interior wedged faces 236 of slips 232 to force slips 232 into tight engagement with the wellbore wall (in the expanded configuration).

However, other arrangements for anchoring mechanism 230, or no anchoring mechanism at all, may be used depending on the particular style of packer 200. For example, anchoring mechanism 230 may include a lower slip assembly and cone that is operated under compressive forces. Anchoring mechanism 230 may also include hold down slips, share rings, and the like. An anchoring mechanism may not be necessary with swellable packers, for example.

According to illustrative principles of the present disclosure, packer 200 includes a sacrificial shroud 250 disposed about packing element 220. Shroud 250 extends the life of packing element 220 when packer 200 is immersed in an incompatible fluid, because packing element 220 is not exposed to the wellbore fluids until after shroud 250 is consumed or depleted. For the same reasons, shroud 250 prevents swabbing of packing element 220 as fluid flows past packer 220 during running into wellbore 102 (FIG. 1), thereby minimizing the likelihood of premature pack-off or preset. Shroud 250 therefore allows run-in speed to be increased, saving time and concomitant cost. In one or more embodiments, shroud 250 may also cover one or more components of actuation mechanism 240 and/or anchoring mechanism 230, thereby protecting such mechanisms from the hostile environment within wellbore 102. Such an arrangement may be advantageous during cementing operations, for example.

FIG. 3 illustrates shroud 250 according to one or more embodiments. Shroud 250 may be formed as a sleeve 252 that is fitted about packing element 220.

Sleeve 252 may also extend over first and second portions 226 and 228, respectively, of the actuation assembly 240 associated with the upper and lower shoulders 222, 224, respectively, as illustrated. Although FIG. 3 illustrates shroud 250 as fully covering packing element 220, in other embodiments, shroud 250 may only partially cover or encase packing element 220. In any case, shroud 250 may be formed as a sleeve 252 that is fitted about packing element 220. Sleeve 252 minimizes or prevents contact of packing element 220 with wellbore fluid and prevents swabbing of packing element 220 due to fluid flow past the element. Sleeve 252 may be made of a material that readily dissolves into the wellbore fluid. Nonlimiting examples of a suitable dissolvable material for sleeve 252 may include metallic and non-metallic materials (such as plastic), examples of which are as follows: Aluminum-gallium alloys such as 80% aluminum-20% gallium; 80% Al-10% Ga-10% In; 75% Al-5% Ga-5% Zn-5% Bi-5% Sn-5% Mg; 90% Al-2.5% Ga-2.5% Zn-2.5% Bi-2.5% Sn; 99.8% Al-0.1% In-0.1% Ga; as well as plastic material such as polyglycolic acid ("PGA"); poly(lactic-co-glycolic acid) ("PLGA"); polylactic acid ("PLA"); polycaprolactone ("PCL"); and polyhydroxyalkonate. The wall thickness of sleeve 252 may be determined based on the rapidity of dissolution of the sleeve material, the speed of run-in, and the depth to which packer 200 is to be deployed.

Sleeve 252 may also be made of a material that will melt when exposed to downhole temperature and/or pressure, such as a suitable thermoplastic or a fusible metal alloy. Fusible metal alloys may be readily made so as to melt within approximately ten degrees of a specific temperature. Thus, a specific alloy may be chosen so as to not melt until packer 200 has neared a target zone, and run-in speed would not be limited by swabbing of elastomeric components until the target zone is reached.

Figure 4:
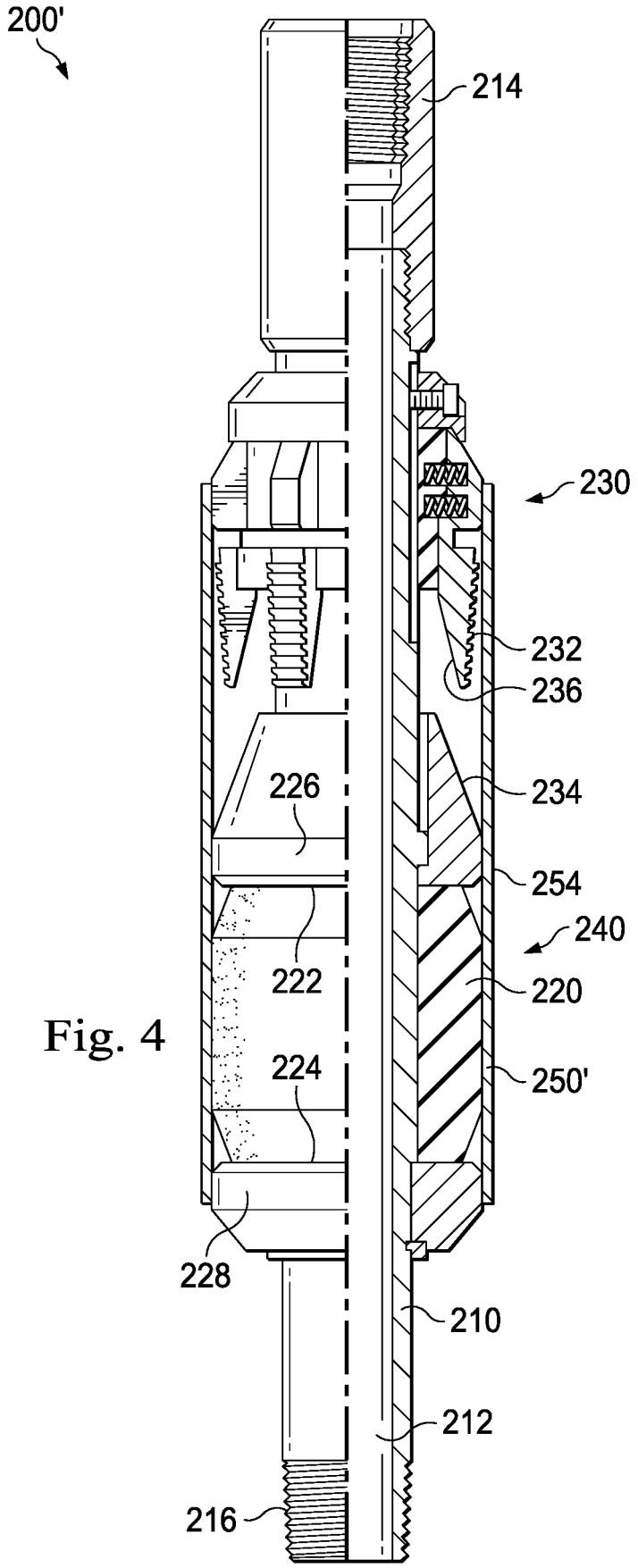
FIG. 4 is an elevation view in partial cross-section of an exemplary downhole packer which may be used in conjunction with the well system of FIG. 2, showing an elastomeric packing element, actuation mechanism, and anchoring mechanism covered by a sleeve-shaped depletive shroud according to an embodiment.

FIG. 4 is an elevation view in partial cross-section of a packer 200', which is substantially the same as packer 200 of FIG. 3. According to one or more embodiments, shroud 250 may be formed as a sleeve 254 that covers packing element 220 and one or more components of actuation mechanism 240 and anchoring mechanism 230. As illustrated in FIG. 4, sleeve 254 covers the expanse packer 200 from anchoring mechanism 232 lower shoulder 224 of actuation mechanism 240. As with sleeve 252 of FIG. 3, sleeve 254 may be made of a dissolvable or a meltable material that protects the covered components from the wellbore environment during initial run-in of packer 200. Sleeve 254 depletes prior to actuation or setting of packer 200.

Figure 5:
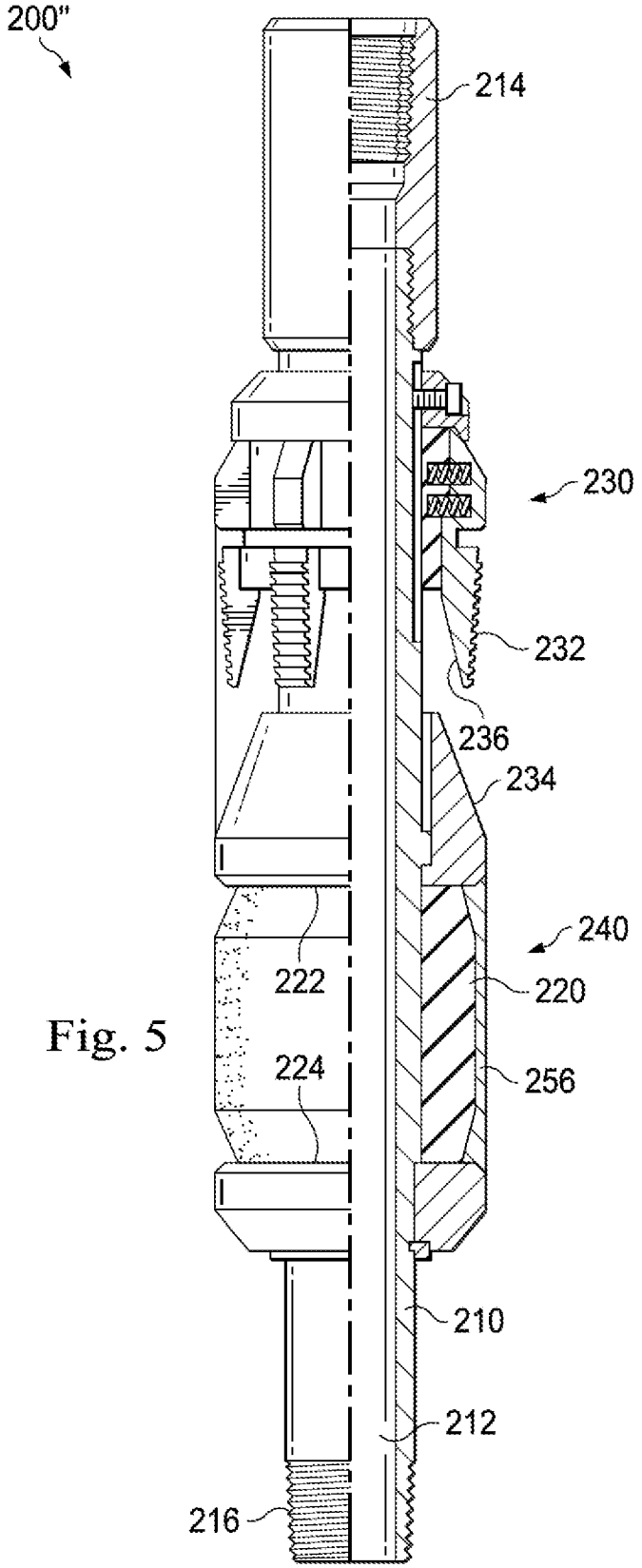
FIG. 5 is an elevation view in partial cross-section of an exemplary downhole packer which may be used in conjunction with the well system of FIG. 2, showing an elastomeric packing element coated by a depletive shroud according to an embodiment.

FIG. 5 is an elevation view in partial cross-section of a packer 200" according to one or more embodiments. As with packer 200 of FIG. 3, packer 200" may include a mandrel 210, elastomeric packing element 220, optional anchoring mechanism 230, and optional actuation mechanism 240. Shroud 250 covers packing element 220 for preventing swabbing and interaction with incompatible wellbore fluids. Shroud 250 may include a coating 256 of depletive material that is deposited or otherwise disposed about packing element 220. The depletive material of coating 256 may be characterized by a melting point at a predetermined temperature or by dissolution into a particular wellbore fluid. Coating 256 may be applied about packing element 220 by any suitable method, including pouring, dipping, spraying, taping, painting, molding, and other known methods. The use of coating 256 may be advantageously used on any current elastomer-based packer without modification to the existing design.

Figure 6:
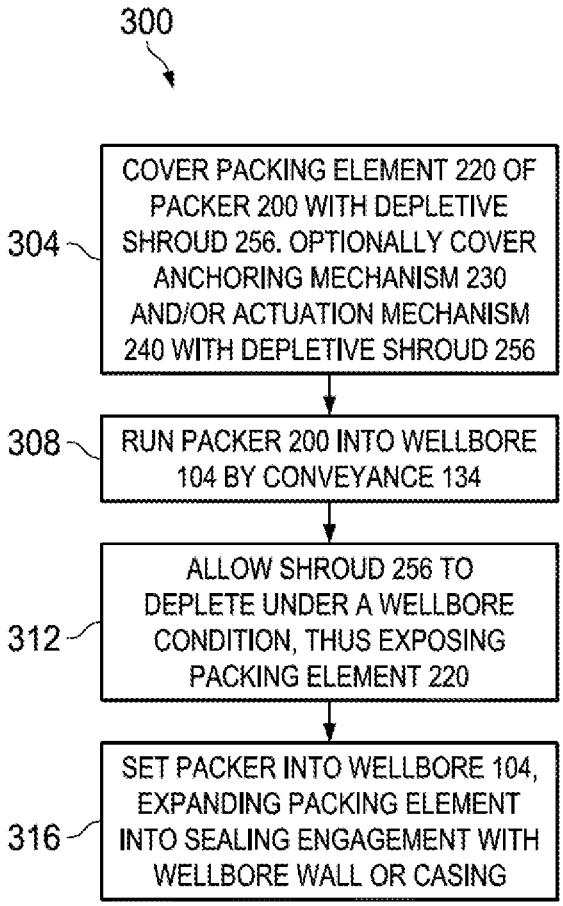
FIG. 6 is a flowchart of a method of wellbore operations according to an embodiment that allows shortened run-in times when deploying downhole packers.

FIG. 6 is a flowchart of a method 300 of wellbore operations according to an embodiment that allows shortened run-in times when deploying downhole packers. Referring initially to FIGS. 3 and 6, at step 304, packing element 220 of downhole packer 200 is covered by consumable, sacrificial depletive shroud 250. Additionally, as illustrated in FIG. 4, actuation mechanism 240 and/or anchoring mechanism 230, if provided, may be covered by depletive shroud 250, in whole or in part, thereby providing protection to such components or element.

As discussed above, shroud 250 may take the form of a thin-walled sleeve 252, 254 (FIGS. 3, 4, respectively) disposed about packer 200 or the form of an applied coating 256 deposited over packer 200 (FIG. 5). However, shroud 250 may take any suitable form.

Depletive shroud 250 may include a material with a predetermined low melting point so that shroud 250 will melt once packer 200 is located within a target region of the wellbore. Examples of suitable melting materials include fusible metal alloys and thermoplastics. Alternatively or additionally, depletive shroud 250 may include a material that dissolves into a given wellbore fluid, such as water or hydrocarbons. Examples of suitable dissolvable materials may include metallic and non-metallic materials (such as plastic), examples of which are as follows: Aluminum-gallium alloys such as 80% aluminum-20% gallium; 80% Al-10% Ga-10% In; 75% Al-5% Ga-5% Zn-5% Bi-5% Sn-5% Mg; 90% Al-2.5% Ga-2.5% Zn-2.5% Bi-2.5% Sn; 99.8% Al-0.1% In-0.1% Ga; as well as plastic material such as polyglycolic acid ("PGA"); poly(lactic-co-glycolic acid) ("PLGA"); polylactic acid ("PLA"); polycaprolactone ("PCL"); and polyhydroxyalkonate.

Referring to FIGS. 1, 2 and 6, at step 308, packer 200, with depletive shroud 250, is run into wellbore 102. Packer 200 may be run into wellbore 102 by wireline or coiled tubing conveyance 134 (FIG. 1) or by drill string, working string, or production tubing string 140 conveyance 134 (FIG. 2), for example. Because packing element 220 is covered by shroud 250, run-in speed is not limited by swabbing considerations, thereby providing potential time and cost savings.

At step 312, as packer 200 is being run to target depth, shroud 250 may begin to deplete, depending on wellbore conditions. Ideally, shroud 250 is designed for use in a particular situation, so that shroud 250 does not fully deplete until packer 200 is at or near the target location, and so that shroud 250 depletes no later than shortly after packer 200 is at or near the target location. In this manner, time until packer 200 can be set is minimized.

Once shroud 250 has been sufficiently depleted, at step 316, packer may be set within wellbore 102, such as by application of tension, compression, torsion, hydraulic force, electrical current, or by swelling. Pacing element 220 is radially expanded into sealing engagement with the wall of wellbore 102 or its casing 104.

Thus, a wellbore packer has been described. The wellbore packer may generally include a mandrel; a radially expandable packing element carried on said mandrel; and a depletive shroud disposed about said packing element. Likewise, a downhole system for deployment in a wellbore has been described. The downhole system may include a wellbore formed in the earth and opening to the surface of the earth; a conveyance extending from the surface of the earth into said wellbore; and a packer carried by said conveyance and disposed within said wellbore, said packer including a mandrel, a radially expandable packing element carried on said mandrel, and a depletive shroud disposed about said packing element. Similarly, downhole system may include a conveyance mechanism extending into a wellbore; and a packer carried by said conveyance mechanism and disposed within said wellbore, said packer including a mandrel, a radially expandable packing element carried on said mandrel, and a depletive shroud disposed about said packing element.

Any of the foregoing may include any one of the following elements, alone or in combination with each other:

- The expandable packing element is formed of an elastomer.
- The expandable packing element is formed of a material selected from the group consisting of nitrile butadiene rubber; hydrogenated nitrile butadiene rubber; water-absorbent resins; cross-linked products of polyacrylates; cross-linked products of starch-acrylate graft copolymers; cross-linked products of a hydrolyzate of starch-acrylonitrile graft copolymer; cross-linked products of carboxymethylcellulose; and ethylene propylene rubber.
- The depletive shroud is a sleeve.

The depletive shroud is a coating.

The shroud at least partially encases the packing element.

The shroud fully encases the packing element.

The shroud at least partially encloses the packing element.

The shroud fully encloses the packing element.

At least one element from the group consisting of an anchoring mechanism carried by said mandrel operable so as to selectively fix said packer within a wellbore and an actuation mechanism operatively coupled to said packing element so as to selectively radially expand said packing element.

At least one element from the group consisting of an anchoring mechanism carried by said mandrel operable so as to selectively fix said packer within a wellbore and an actuation mechanism operatively coupled to said packing element so as to selectively radially expand said packing element, wherein said depletive shroud covers said at least one element.

The depletive shroud is formed of a material meltable under a wellbore thermodynamic condition.

The shroud material is a fusible metal alloy.

The shroud material is a thermoplastic.

The depletive shroud is formed of a material dissoluble into a wellbore fluid.

The depletive shroud is formed of aluminum-gallium alloy.

The depletive shroud is formed of a metallic material selected from the group consisting of 80% aluminum-20% gallium; 80% Al-10% Ga-10% In; 75% Al-5% Ga-5% Zn-5% Bi-5% Sn-5% Mg; 90% Al-2.5% Ga-2.5% Zn-2.5% Bi-2.5% Sn; and 99.8% Al-0.1% In-0.1% Ga.

The depletive shroud is formed of a plastic material selected from the group consisting of polyglycolic acid ("PGA"); poly(lactic-co-glycolic acid) ("PLGA"); polylactic acid ("PLA"); polycaprolactone ("PCL"); and polyhydroxyalkonate.

Thus, a method of wellbore operations has been described. The method of wellbore operations may generally include covering a packing element of a packer with a depletive shroud; running said packer into a wellbore formed in the earth; allowing said shroud to deplete under a wellbore condition; and then setting said packer within said wellbore.

The foregoing method may include any one of the following steps, alone or in combination with each other:

Covering at least one of the group consisting of an anchoring mechanism carried by said mandrel operable so as to selectively fix said packer within a wellbore and an actuation mechanism operatively coupled to said packing element so as to selectively radially expand said packing element with said depletive shroud.

Covering said packing element with said depletive shroud formed of a material dissoluble into a wellbore fluid.

Covering said packing element with said depletive shroud formed of a material meltable under a wellbore thermodynamic condition.

Forming the depletive shroud from a material selected from the group consisting of a fusible metal alloy and a thermoplastic.

Covering comprises deploying a depletive sleeve to at least partially enclose said packing element.

Covering comprises coating the packing element with a depletive material that at least partially encases said packing element.

The Abstract of the disclosure is solely for providing the a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A wellbore packer, comprising:

a mandrel;

a radially expandable packing element carried about said mandrel;

an actuation mechanism operatively coupled to said packing element so as to selectively radially expand said packing element, wherein the actuation mechanism comprises axially spaced first and second shoulders by which the packing element is engaged and between which the packing element is axially compressible to selectively radially expand said packing element;

a depletive shroud disposed about said packing element, wherein said depletive shroud covers at least first and second portions of said actuation mechanism associated with the first and second shoulders, respectively, and wherein said depletive shroud extends from said first portion to said second portion of said actuation mechanism to cover said packing element;

and an anchoring mechanism carried by said mandrel at a location relatively closer to the first portion than the second portion of the actuation mechanism, said anchoring mechanism including a plurality of radially extendable slips being operable from an unexpanded configuration to an expanded configuration to selectively fix said packer within a wellbore, wherein, in the unexpanded configuration:

the anchoring mechanism is spaced apart, and disengaged, from the actuation mechanism, which includes the first portion, said depletive shroud secured to the radially extendable slips such that the depletive shroud covers at least a portion of said anchoring mechanism, and said depletive shroud extends from said slips to said second portion of said actuation mechanism to cover said packing element, said depletive shroud secured to said second portion of said actuation mechanism;

and wherein, to operate the anchoring mechanism from the unexpanded configuration to the expanded configuration:

the depletive shroud is adapted to be depleted, and the radially extendable slips of the anchoring mechanism and second portion of the actuation mechanism are adapted to be brought into engagement with each other; and wherein: said depletive shroud is formed of a material meltable under a wellbore thermodynamic condition; wherein: said material is a fusible metal alloy fused to the radially extendable slips and to said second portion of said actuation mechanism.

2. The packer of claim 1, wherein:

said depletive shroud is a sleeve circumscribing a serrated portion of the radially extendable slips.

3. A well system, comprising:

a wellbore formed in the earth and opening to the surface of the earth;

a conveyance extending from the surface of the earth into said wellbore; and a packer carried by said conveyance and disposed within said wellbore, said packer comprising:

a mandrel;

a radially expandable packing element carried about said mandrel, an actuation mechanism operatively coupled to said packing element so as to selectively radially expand said packing element, wherein the actuation mechanism comprises axially spaced first and second shoulders by which the packing element is engaged and between which the packing element is axially compressible to selectively radially expand said packing element;

a depletive shroud disposed about said packing element, wherein said depletive shroud is secured to said actuation mechanism and covers at least first and second portions of said actuation mechanism associated with the first and second shoulders, respectively, and wherein said depletive shroud extends from said first portion to said second portion of said actuation mechanism to cover said packing element;

and an anchoring mechanism carried by said mandrel at a location relatively closer to the first portion than the second portion of the actuation mechanism, said anchoring mechanism being secured to said depletive shroud operable from an unexpanded configuration to an expanded configuration upon depletion of the shroud to selectively fix said packer within said wellbore, wherein, in the unexpanded configuration:

the anchoring mechanism is spaced apart, and disengaged, from the actuation mechanism, which includes the first portion, said depletive shroud covers at least a portion of said anchoring mechanism, and said depletive shroud extends from said anchoring mechanism to said second portion of said actuation mechanism to cover said packing element, and wherein, to operate the anchoring mechanism from the unexpanded configuration to the expanded configuration:

the depletive shroud is adapted to be depleted, and the anchoring mechanism and the actuation mechanism are adapted to be brought into engagement with each other; and wherein: said depletive shroud is formed of a material meltable under a wellbore thermodynamic condition; wherein: said material is a fusible metal alloy fused to the radially extendable slips and to said second portion of said actuation mechanism.

4. The well system of claim 3, wherein:

said depletive shroud is a sleeve secured to radially extendable slips of the anchoring mechanism and circumscribing a serrated portion of the radially extendable slips.

5. The well system of claim 3, wherein:

said conveyance includes one from the group consisting of a drill string, a working string, a production tubing string, a coiled tubing, and a wireline.

6. A method of wellbore operations, comprising:

covering a packing element of a packer with a depletive shroud;

covering at least first and second portions of an actuation mechanism of the packer with said depletive shroud so that said depletive shroud extends from said first portion to said second portion of said actuation mechanism to cover said packing element, the at least first and second portions of the actuation mechanism being associated with first and second shoulders, respectively, of the actuation mechanism, by which first and second shoulders the packing element is engaged, and between which first and second shoulders the packing element is axially compressible to selectively radially expand said packing element;

covering at least a portion of an anchoring mechanism of the packer with said depletive shroud, when the anchoring mechanism is in an unexpanded configuration in which the anchoring mechanism is spaced apart, and disengaged, from the actuation mechanism, which includes the first portion, so that said depletive shroud extends from said anchoring mechanism to said second portion of said actuation mechanism to cover said packing element, said anchoring mechanism being carried by a mandrel at a location relatively closer to the first portion than the second portion of the actuation mechanism, said anchoring mechanism being operable from the unexpanded configuration to an expanded configuration to selectively fix said packer within said wellbore;

securing the depletive shroud to radially extendable slips of the anchoring mechanism and to the actuation mechanism;

running said packer into a wellbore formed in the earth; and allowing said depletive shroud to deplete under a wellbore condition; and then radially extending said slips and setting said packer within said wellbore by bringing the anchoring mechanism and the actuation mechanism into engagement with each other; and wherein: said depletive shroud is formed of a material meltable under a wellbore thermodynamic condition; wherein: said material is a fusible metal alloy fused to the radially extendable slips and to said second portion of said actuation mechanism.

7. The method of claim 6, wherein:

the depletive shroud comprises a depletive sleeve; and covering the packing element comprises deploying the depletive sleeve to at least partially enclose said packing element.

* * * * *